US008573869B2

(12) United States Patent
Momose et al.

(10) Patent No.: US 8,573,869 B2
(45) Date of Patent: Nov. 5, 2013

(54) LABEL SHEET CONVEYANCE DEVICE AND METHOD OF IDENTIFYING SEAMS BETWEEN LABEL SHEETS

(75) Inventors: Tsutomu Momose, Okaya (JP); Satoshi Omoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 128 days.

(21) Appl. No.: 13/220,515

(22) Filed: Aug. 29, 2011

(65) Prior Publication Data

US 2013/0020758 A1 Jan. 24, 2013

(30) Foreign Application Priority Data

Jul. 22, 2011 (JP) ..... 2011-160722

(51) Int. Cl.
*B41J 11/26* (2006.01)

(52) U.S. Cl.
USPC ..... 400/611; 101/288; 101/485

(58) Field of Classification Search
CPC ..... B65C 9/46
USPC ..... 400/611; 101/288, 485
See application file for complete search history.

(56) References Cited

U.S. PATENT DOCUMENTS

| | | | | |
|---|---|---|---|---|
| 5,564,846 | A * | 10/1996 | Katsumata | 400/611 |
| 7,025,517 | B2 * | 4/2006 | Inaba | 400/611 |
| 8,223,182 | B2 * | 7/2012 | Komatsu | 347/218 |
| 8,303,198 | B2 * | 11/2012 | Nishimura et al. | 400/76 |
| 2005/0025554 | A1 * | 2/2005 | Inaba | 400/611 |

FOREIGN PATENT DOCUMENTS

JP 02-139329 A 5/1990

* cited by examiner

*Primary Examiner* — Kaitlin Joerger
(74) *Attorney, Agent, or Firm* — Kilpatrick Townsend & Stockton LLP

(57) ABSTRACT

A label sheet conveyance device is provided to more accurately automatically detect seams between label sheets in a label printer.

Using a first threshold value that is set according to the mode of sensor output values for detecting the sheet portion between labels, and a second threshold value that is greater than the first threshold value for detecting holes in the label sheet, a label printer determines a sheet position where the sensor output value is equal to each threshold value. If a sheet position equal to the second threshold value is detected, the center of that sheet position is identified as the seam position. If a sheet position equal to the second threshold value is not identified and a sheet position equal to the first threshold value is identified, the center of that sheet position is identified as the seam position.

16 Claims, 13 Drawing Sheets

LABEL SHEET CONVEYANCE DEVICE AND METHOD OF IDENTIFYING SEAMS BETWEEN LABEL SHEETS

This application claims priority to Japanese Patent Application No. 2011-160722, filed Jul. 22, 2011, the entirety of which is incorporated by reference herein The present invention relates to a label sheet conveyance device and a method of identifying seams between label sheets.

RELATED ART

Label printers that print labels for application to products and packages, for example, are known from the literature. Labels that are applied to luggage (such as carry-on luggage and checked luggage belonging to airline passengers) or attached to luggage handles, for example, are commonly called baggage tags.

Such labels are typically supplied affixed to a release paper liner (referred to below as a "sheet") with a specific gap ("label gap" below) rendered lengthwise between adjacent labels (such sheets with affixed labels are referred to below as "label sheets"). When used, the labels are peeled from the sheet and affixed to the product or luggage. The label sheets are, for example, supplied as roll paper or fanfold paper (continuous paper) with perforations rendered between the labels so that the sheet can be easily torn between labels. More specifically, these perforations are seams between individual label sheets. The seams can be cut manually by the user or automatically by the label printer.

The label printer conveys the label sheets in a specific direction and prints to the individual labels. Some printers also have a cutter that separates the sheets after each label is printed. Label printers therefore typically have a sensor for detecting the label edges or the positions between the labels.

Such sensors include transmissive sensors that detect the amount of light passing through the conveyed label sheet by means of a light-emitting device and a photodetector disposed at appropriate opposing positions on the front and back sides of the label sheet. The label paper detects the label edges or the part of the sheet between labels from the change in transmitted light. The sensor could also be a reflective sensor that detects how much light is reflected from the conveyed label sheet using a light-emitting device and a photodetector disposed on the same side of the paper. This type of label printer detects the label edges or the part of the sheet between labels from the change in reflected light.

Patent Document 1 describes a label printer with a transmissive sensor.

PATENT DOCUMENTS

[Patent Document 1] Japanese Unexamined Patent Appl. Pub. JP-A-H02-139329

SUMMARY OF THE INVENTION

Problem to be Solved

Label sheets used for the same purpose and application may also be manufactured to different specifications. For example, the specifications of baggage tags used for airline luggage may differ according to the airline company or the baggage tag manufacturer. Differences in specifications include, for example, forming or not forming holes in the sheet perforations between labels, providing or not providing slits in the labels to make the labels easier to peel from the sheet, and embedding or not embedding a semiconductor chip and antenna in the labels for RFID (Radio Frequency IDentification) applications. The light reflectance and transmittance of the label sheets may also differ according to the type of label and sheet materials that are used, and the width of the label gaps or slits may vary with temperature variations and aging.

Therefore, when the label sheet is replaced with a label sheet manufactured to different specifications, or the quality of the label sheet media varies, the label printer according to the related art may not be able to correctly recognize the label edges or seams between labels, resulting in label sheet cutting errors. Furthermore, the user must also manually input the length of each label sheet in order for the label printer to operate correctly, and usability is thus poor.

An object of the present invention is therefore to enable a label printer to more accurately automatically detect seams between the individual sheets of a label sheet medium.

Means of Solving the Problem

A first aspect of the invention solving the foregoing problem is a label conveyance device that conveys a label sheet having a plurality of labels arrayed with a gap therebetween on a sheet, characterized by: a sensor that scans the label sheet and outputs a sensor output value; a mode determination means that determines a mode of sensor output values; a sheet position determination means that determines a first sheet position in the label sheet conveyance direction where the sensor output value exceeds a first threshold value that is set according to the mode and used for detecting a part of the sheet between labels, a second sheet position where the sensor output value exceeds a second threshold value that is greater than the first threshold value and is used for detecting a hole in the label sheet, a third sheet position where the sensor output value is less than the second threshold value, and a fourth sheet position where the sensor output value is less than the first threshold value; and a seam position detection means that determines that the center of a first interval from the first sheet position to the fourth sheet position is the position of a seam in the sheet between labels when the first sheet position and the fourth sheet position are identified and the second sheet position and the third sheet position are not identified, and determines that the center of a second interval from the second sheet position to the third sheet position is the position of a seam in the sheet between labels when the second sheet position and the third sheet position are identified.

In another aspect of the invention, the first threshold value may be the sum of the mode plus a specific value.

The label conveyance device may also be characterized by having a maximum determination means that determines the maximum sensor output value, and setting the first threshold value according to the difference between the mode and the maximum. In this case, the label conveyance device may be characterized by having a threshold value setting means that sets the sum of a specific ratio of the difference between the mode and the maximum plus the mode as the first threshold value.

In addition, the seam position detection means may be characterized by determining if the length of the first interval exceeds a specific distance if the first sheet position and the fourth sheet position are determined and the second sheet position and third sheet position are not determined, and determining that the center of the first interval is the position of a seam in the sheet between labels if the length of the first interval exceeds the specific distance.

The seam position detection means may also be characterized by determining if the length of the first interval exceeds a specific distance if the first sheet position and the fourth sheet position are determined and the second sheet position and third sheet position are not determined, and resetting at least the first sheet position and the fourth sheet position without determining the position of a seam in the sheet between labels if the length of the first interval does not exceed the specific distance.

The mode determination means by also be characterized by determining the mode using a sensor output value in a first specific interval after starting conveyance of the label sheet; and the sheet position determination means determining each sheet position using a sensor output value in an interval downstream in the conveyance direction from the specific interval.

The mode determination means may also be characterized by continuously determining and updating the mode using the sensor output value after starting conveyance of the label sheet.

In another aspect of the invention, a second specific interval in which a chip storing identification information and an antenna for communicating the identification information is disposed to the label; and the mode determination means is characterized by not using a sensor output value in the second specific interval to determine the mode.

Yet further, the position determination means may be characterized by using a sensor output value in an interval conveyed after the center of the first interval is identified as the position of a sheet seam between labels to determine the second sheet position and the third sheet position; and the seam position detection means characterized by determining the center of the first interval is the position of a sheet seam between labels when the second sheet position and the third sheet position are not determined, and determining the center of a second interval from the second sheet position to the third sheet position is the position of a sheet seam between labels when the second sheet position and the third sheet position are determined.

In another aspect of the invention, the sensor is a light-emitting element and a photodetection device, or an ultrasonic emitting device and an ultrasonic detection device, disposed to opposing positions with the label sheet therebetween.

The sensor may also be characterized by scanning the label sheet at a plurality of positions arrayed perpendicularly to the conveyance direction of the label sheet, and being able to output a sensor output value at each of the plural positions.

In another aspect of the invention, the mode determination means, sheet position determination means, and seam position detection means can function using sensor output values from the plural positions, and of the sensors disposed to the plural positions, use the sensor that first outputs a sensor output value identifying the first sheet position as the sensor for determining subsequent sheet positions.

In another aspect of the invention, the mode determination means, sheet position determination means, and seam position detection means can function using sensor output values from the plural positions, and of the sensors disposed to the plural positions, use the sensor that first outputs a sensor output value identifying the seam position as the sensor for determining subsequent sheet positions.

Another aspect of the invention is characterized by the mode determination means, sheet position determination means, and seam position detection means being able to function using sensor output values from the plural positions, and further comprising an evaluation means that determines the shape of the sheet part between labels based on the sheet positions identified by each sensor output value.

Another aspect of the invention for solving the foregoing problem is a sheet seam determination method of a label conveyance device that conveys a label sheet having a plurality of labels arrayed with a gap therebetween on a sheet, and has a sensor that scans the label sheet and outputs a sensor output value, the sheet seam determination method characterized by: a step that determines a mode of sensor output values; a step that determines a first sheet position in the label sheet conveyance direction where the sensor output value exceeds a first threshold value that is set according to the mode and used for detecting a part of the sheet between labels; a step that determines a second sheet position in the label sheet conveyance direction where the sensor output value exceeds a second threshold value that is greater than the first threshold value and is used for detecting a hole in the label sheet; a step that determines a third sheet position in the label sheet conveyance direction where the sensor output value becomes less than the second threshold value; a step that determines a fourth sheet position in the label sheet conveyance direction that is less than the first threshold value; a step that determines the center of a first interval from the first sheet position to the fourth sheet position is the position of a seam in the sheet between labels if the second sheet position and the third sheet position are not identified when the fourth sheet position is identified; and a step that determines the center of a second interval from the second sheet position to the third sheet position is the position of a seam in the sheet between labels if the second sheet position and the third sheet position are identified when the fourth sheet position is identified.

Other objects, configurations, and effects will be known from the following description of embodiments.

DESCRIPTION OF EMBODIMENTS

A preferred embodiment of the present invention is described below with reference to the accompanying figures.

This embodiment of the invention describes a label printer as an example of a label conveyance device.

A label printer according to this embodiment of the invention scans the label sheet by means of a transmissive sensor while conveying the label sheets, and based on the acquired sensor output determines the locations of the sheet seams between labels.

Each time the roll of label sheet media is replaced, for example, the label printer according to this embodiment of the invention finds the seam of the next sheet and determines the length of the label sheet for one label (the length from one seam to the next seam) by first conveying the label sheet media a specified distance including at least one label sheet from the beginning of the roll (from the leading end of a label sheet that was cut correctly at a sheet seam between labels). After calculating the length of the label sheet for one label, the label printer cuts the label sheet every time the label media is conveyed the calculated distance until the roll is changed again. A configuration that individually determines the location of the seam in the sheet to cut each label is also conceivable.

Note that because the label printer can detect the label sheet conveyance distance based on the number of steps the paper feed motor is driven, for example, the length of the label sheet for one label can be determined once the location of a seam in the sheet is determined.

Figure 1:
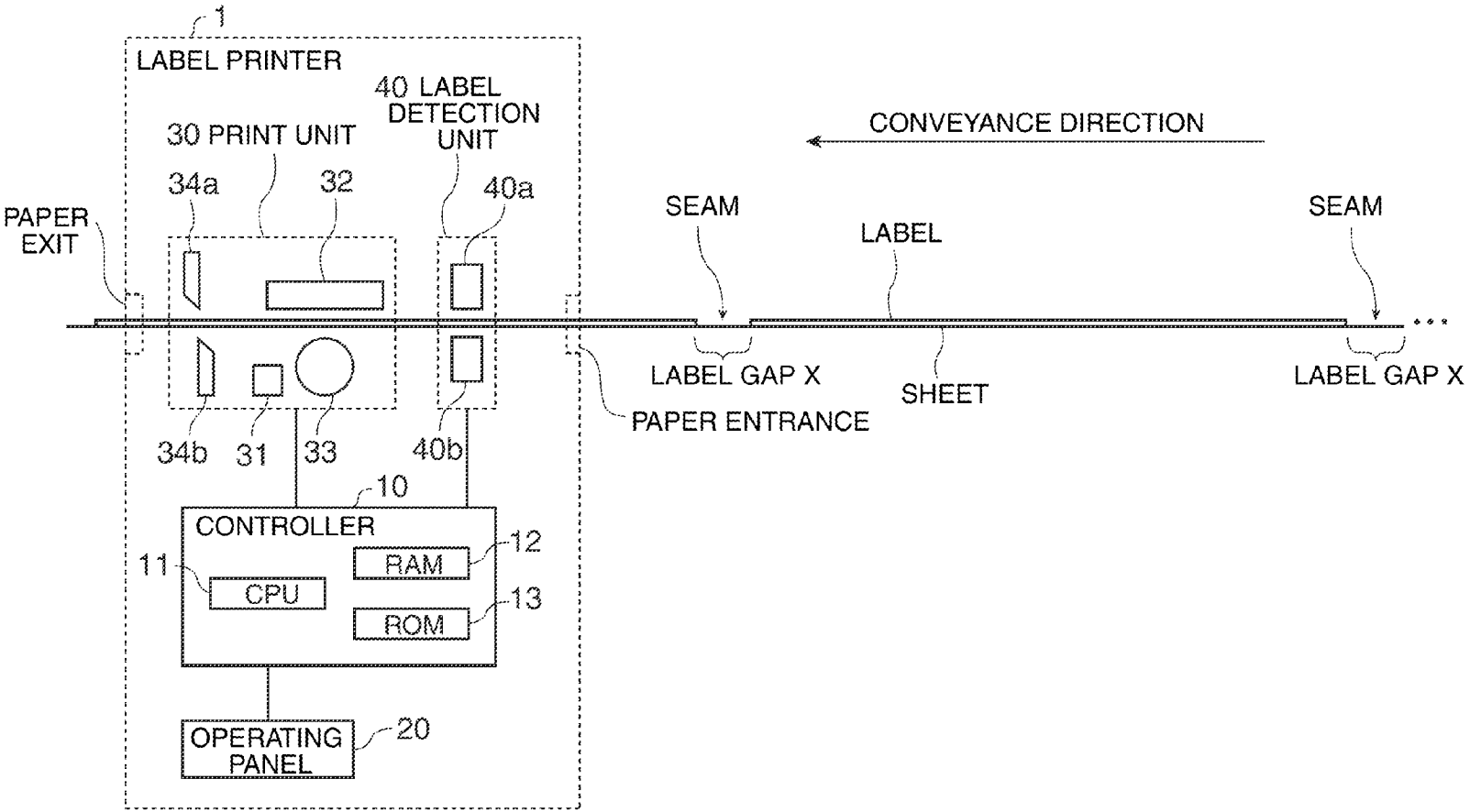
FIG. 1 shows an example of the basic configuration of a label printer according to a preferred embodiment of the invention.

FIG. 1 schematically describes the configuration of a label printer according to a preferred embodiment of the invention.

The label printer 1 includes a controller 10, operating panel 20, print unit 30, and label detection unit 40. The label detection unit 40, printhead 32, platen roller 33, and cutter 34 are disposed in this order to the label printer 1 from the paper supply entrance to the paper exit.

The controller 10 is a unit that centrally controls the label printer 1.

The controller 10 includes a CPU 11, RAM 12, and ROM 13. The CPU 11 reads and executes a specific program from ROM 13 in RAM 12, for example, to control other printer units and implement label printer 1 functions.

The controller 10 could obviously also be rendered with interface circuits and drive circuits for controlling the operating panel 20, print unit 30, and label detection unit 40, for example. These circuits could also be disposed externally to the controller 10.

The controller 10 conveys the label sheet, prints on labels, and cuts the label sheet, for example, by controlling operation of the appropriate parts of the print unit 30 (the paper feed motor 31, printhead 32, and cutter 34). The controller 10 also acquires the sensor output values output from the label detection unit 40 while conveying the label sheet, for example, and determines the location of a sheet seam between labels. Note that the controller 10 stores the scanning position based on the step count of the paper feed motor 31, for example, correlated to the sensor output value at that position in RAM 12, for example.

The operating panel 20 is an input/output interface between the user and the label printer 1. For example, the operating panel 20 has a display and input device. The operating panel 20 displays information on the display according to instructions from the controller 10, for example. The operating panel 20 also reports input device operations to the controller 10.

The print unit 30 is a label printing unit. The print unit 30 includes the paper feed motor 31, printhead 32, platen roller 33, and cutter 34, for example.

The paper feed motor 31 is a stepper motor, for example, that turns a specific angle (one step) as controlled by the controller 10, and causes the platen roller 33 and other paper feed rollers (not shown in the figure) through an intervening gear train, for example. The label sheet is conveyed in a specific conveyance direction by rotation of the platen roller 33 and other paper feed rollers.

The printhead 32 is a thermal printhead, for example, and prints on the labels of the label sheet pressed thereto by the platen roller 33. The printhead 32 prints based on control data sent from the controller 10.

The cutter 34 is a unit that cuts the label sheet. The cutter 34 includes, for example, a top knife 34*a* and a bottom knife 34*b* disposed on opposite sides of the label sheet, and cuts the label sheet by moving one or both knives vertically. The cutter 34 cuts the label sheet as controlled by the controller 10.

The label detection unit 40 is a transmissive sensor. The label detection unit 40 includes, for example, a photodetector 40*a* and a light-emitting device 40*b*. The photodetector 40*a* and light-emitting device 40*b* are disposed to opposing positions on the front and back sides of the conveyed label sheet. The label detection unit 40 detects the amount of light passing through the label sheet by means of the photodetector 40*a* each time the label sheet is conveyed a specific distance (every one or two or more steps), converts the detected light to a voltage or other digital value, and outputs the result as the sensor output value to the controller 10.

Note that in this embodiment of the invention sensor output increases as transmittance increases.

Figure 2:
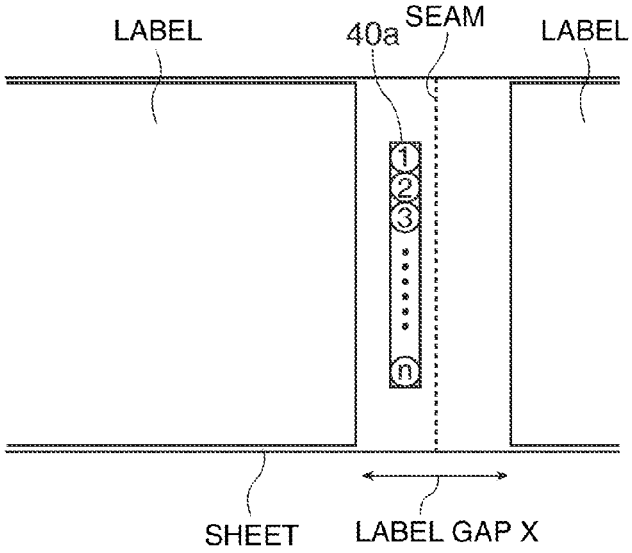
FIG. 2 shows an example of the configuration of a label detection unit (photodetection device).

The photodetector 40*a* in this embodiment of the invention may be configured using a plurality of photodetection elements 1 to n arrayed in a line perpendicular to the conveyance direction of the label sheet as shown in FIG. 2, for example. The label detection unit 40 outputs the amount of light detected by the photodetection elements as the sensor output value to the controller 10. The controller 10 can capture the sensor output values from each photodetection element, and identify the location of a seam between the sheets therefrom.

The light-emitting devices 40*b* can be rendered with LEDs or other light-emitting device corresponding individually to the photodetection elements of the photodetector 40*a*. The configuration of the light-emitting device 40*b* is obviously not limited to this configuration.

The configuration of the label detection unit 40 is obviously not limited to the above, and a configuration having an ultrasonic receiver and an ultrasonic emitter disposed to opposing positions on the front and back sides of the label sheet, for example, is also conceivable. A reflective sensor may also be used instead of a transmissive sensor.

Referring again to FIG. 1, the label sheet consists of a sheet of release paper to one side of which labels are affixed in line with a specific gap therebetween (label gap X). The label sheet is roll paper or fanfold paper (continuous paper) having a perforated seam formed in the center of the label gap X so that the sheet can be separated at each label. The specifications of different types of label sheets are described below with reference to FIG. 4.

Figure 3:
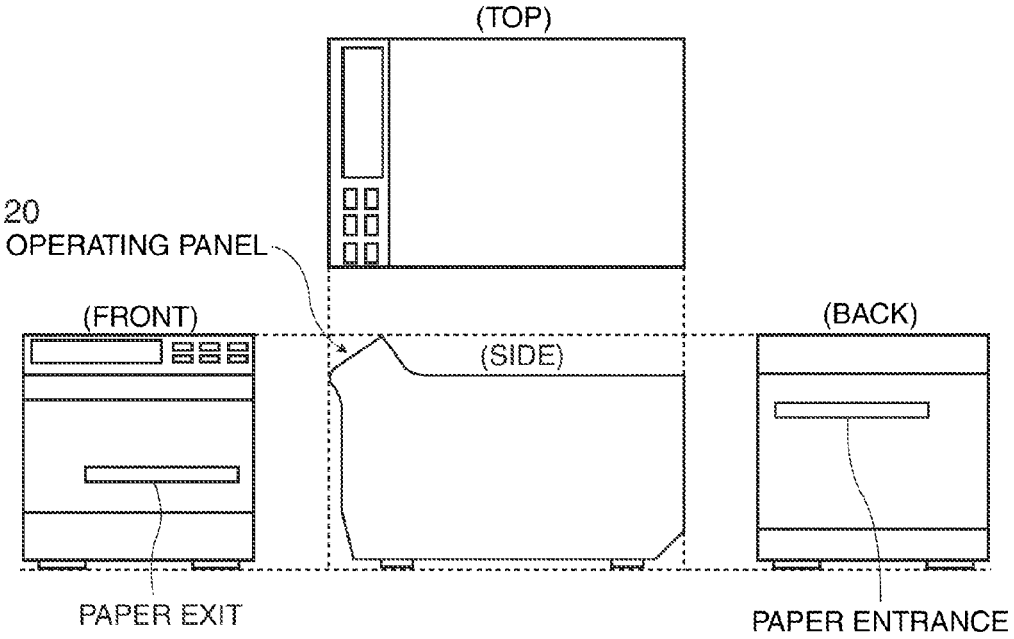
FIG. 3 shows an example of the appearance of a label printer.

As shown in FIG. 3, for example, a paper entrance for supplying label sheets is formed in the back of the outside of the label printer 1. A paper exit from which the label sheet is discharged is formed in the front. Label sheets are inserted to the paper entrance and conveyed through the paper feed path not shown inside the label printer 1 toward the paper exit. The label sheet roll paper or fanfold paper is loaded into a device (not shown in the figure) separate from the label printer 1, for example, and is supplied sequentially from this separate device when the label sheet is pulled by the label printer 1.

Figure 4:
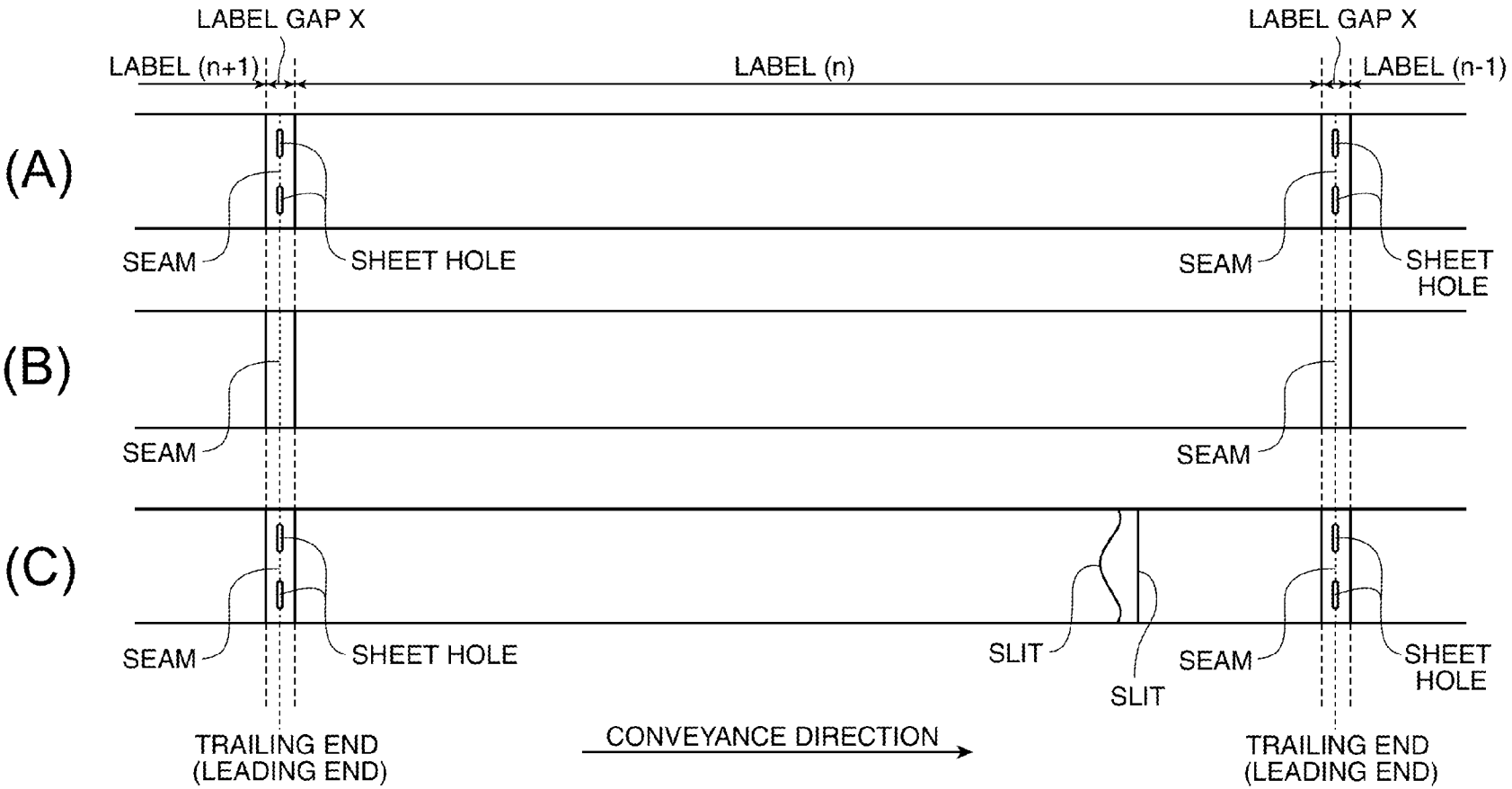
FIG. 4 shows an example of label sheet specifications.

FIG. 4 shows an example of label sheet specifications. This example shows three label sheets (A) to (C). This example shows the portion of the label sheet containing one label (a label sheet including label (n)) between one seam and the next seam, and portions of the before and after label sheets (the label sheet including label (n−1) and the label sheet including label (n+1)).

Label sheet (A) has a perforation (seam) formed perpendicularly to the conveyance direction in the middle of each label gap, and has two sheet holes formed in each perforation. The sheet holes are provided for easy detection of the seams by the sensor.

Unlike label sheet (A), label sheet (B) does not have sheet holes.

Label sheet (C) also differs from label sheet (A) by also having two slits in each label. The slits are provided so that the labels can be easily peeled from the sheet, and so that the labels can be easily separated into plural parts.

The label sheet specifications described above are for example only, and the size, number, and locations of the sheet holes and slits, for example, are not limited thereto. The length of the labels and the label sheet for one label are also not limited to the foregoing. The form of the seams is also not limited to perforations, and the sheet does not need to be perforated.

Examples of the label printer 1 and label sheet are described above. It will be obvious that this configuration describes parts important to describing the features of the present invention, and the invention is not limited thereto. The foregoing also does not eliminate parts common to a typical label printer or label sheet.

The method whereby the label printer 1 described above detects a seam in the label sheet is described next.

When the photodetector 40*a* has a plurality of photodetection elements, the controller 10 uses the output of any one previously selected photodetection element. For example, a photodetection element at any position can be used if only label sheets that do not have sheet holes are used, but because label sheets with sheet holes may also be conveyed, the controller 10 is preferably configured to use a photodetection element positioned where the sheet holes pass. When the light-emitting device 40*b* is configured with a plurality of photodetection elements, the light-emitting element corresponding to the selected photodetection element is preferably used.

Note that the controller 10 may also use the sensor output values from a plurality of photodetection elements. When sensor output values are output from plural photodetection elements, the maximum output value is preferably used. This enables detecting sheet holes.

As described above, the label sheets may be manufactured to different specifications. Light transmittance differs between label sheets according to the materials used to make the labels and sheets, and the width of the label gap and the width of the slits may vary according to changes in temperature and age. The label printer 1 therefore has a configuration for more accurately detecting the seams between such label sheets.

When the roll is changed in this embodiment of the invention, for example, the leading end of the label sheet is manually inserted by the user from the paper entrance to the label printer 1 to a specific position on the conveyance path. This specific position is, for example, the position of a paper feed roller (not shown in the figure) on the paper entrance side or the paper exit side of the label detection unit 40. When a sensor, for example, detects that the leading end of the label sheet was inserted to the specific position, the controller 10 causes the paper feed roller to turn a specific number of steps and stop at a specific starting position. Note that this process is referred to below as the loading process.

The controller 10 starts conveying the label sheet after the label sheet loading process.

In order to determine the length of the label sheet for one label, the label sheet for at least one label must pass the label detection unit 40. Because many different types of label sheet media may be used as described above, the controller 10 in this embodiment of the invention conveys a length equal to the length of the longest label sheet that might be used from the leading end of the label sheet passed the label detection unit 40.

When label sheet conveyance starts after the label sheet loading process, the controller 10 captures the sensor output values of the label detection unit 40 for a specified distance from the leading end of the label sheet in order to calculate the mode J of the sensor output values for the label.

The specific distance needed to calculate the mode J can be any length including an interval of at least part of a label, and has no specific length or starting position. However, because a length sufficient to determine the mode of the label sensor output values is needed and the mode J must be determined before a seam is reached, this specific distance is preferably shorter than the length of the shortest label that might be selected from among labels of different specifications. This distance is preferably set to the optimum value determined statistically based on test results, for example.

The controller 10 counts the number of times each sensor output value is detected within the specific distance used for calculating the mode J, and generates a histogram of the sensor output values. After the label sheet is conveyed the specific distance, the mode J of the sensor output values is determined from the generated histogram. For example, if the color of the label backing is white, a value corresponding to white will be the mode.

Note that the method of calculating the mode J is not limited to methods based on the sensor output values within a specific distance as described above. For example, the controller 10 could continuously acquire the sensor output values and constantly update the histogram and constantly detect the mode J until the seam position is determined. In this case, the controller 10 also constantly calculates the threshold value A described below together with the mode J.

The controller 10 also sets a threshold value A by adding a specific value $\alpha$ to the calculated mode J. This specific value $\alpha$ reflects variation in the sensor output values above and below the referenced mode J, and is set so that the maximum variation does not exceed threshold value A. This value can be set by experimentally measuring the sensor output value in the specific distance used to calculate the mode when using label sheets manufactured to different specifications, and set to a statistically determined optimum value.

The controller 10 also sets a threshold value H for detecting sheet holes. This threshold value H enables evaluating the sensor output values corresponding to the amount of light when a label sheet is not present, and can be preset.

After setting threshold value A and threshold value H, the controller 10 continues conveying the label sheet, and tries to find scanning position P1A where the sensor output value becomes equal to threshold value A while rising, scanning position P2H where the sensor output value becomes equal to threshold value H while rising, scanning position P3H where the sensor output value becomes equal to threshold value H while decreasing, and scanning position P4A where the sensor output value becomes equal to threshold value A while decreasing.

Figure 5:
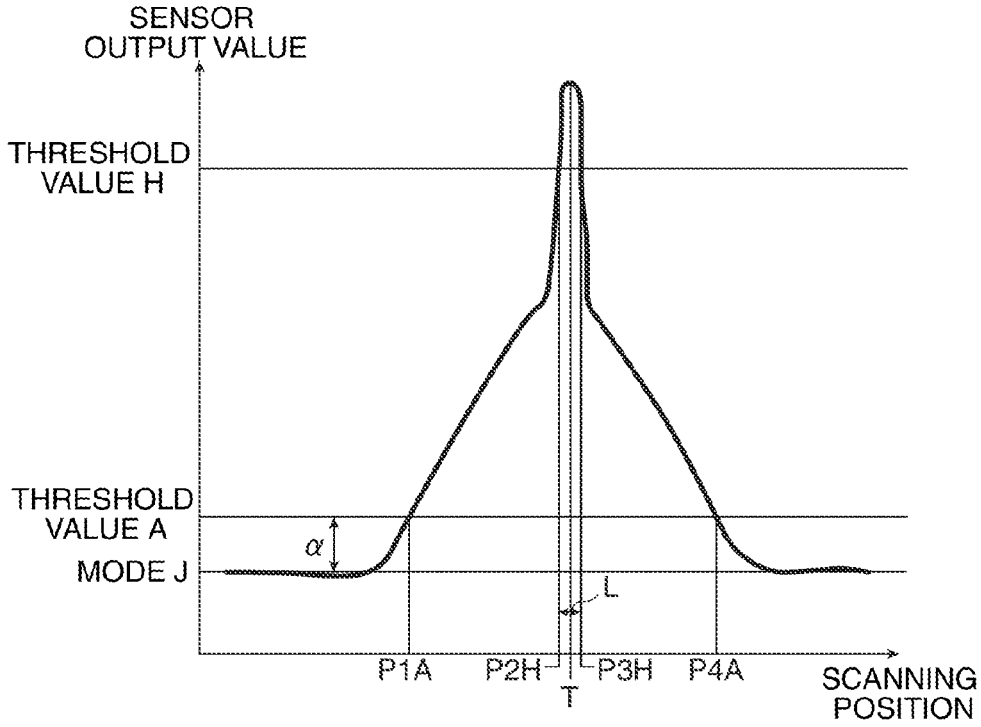
FIG. 5 describes the relationship between the scanning position and sensor output when using label sheets with holes in the perforations.

A method of determining the seam positions when sheet holes are formed in the seams between labels (such as shown in FIGS. 4 (A) and (C)) is described next. FIG. 5 describes the relationship between the scanning position of the label sheet where there are sheet holes, and the sensor output values. This figure shows the sensor output values between labels and in the areas before and after the label gap.

As shown in the figure, the sensor output value begins rising when the scanning position moves to the sheet part in the label gap, and rises even more quickly as the scanning position approaches the sheet holes. The sensor output value peaks near the center of the sheet hole, drops rapidly toward the trailing end of the sheet hole, and then drops on a more gradual slope toward the trailing end of the sheet inside the label gap.

If scanning positions P1A and P4A can be detected and scanning positions P2H and P3H can be detected, the controller 10 determines there is a sheet hole in the label gap. The controller 10 then identifies center position T at half the distance (gap) L between scanning positions P2H and P3H as the center of the sheet hole, that is, as the seam between label sheets.

If all scanning positions P1A, P4A, P2H, and P3H are detected, a sheet hole is determined to be in the label gap. This is because some label sheets are made with through-holes (label sheet holes) passing through both the label and the sheet at a position outside the label gap, and it is necessary to differentiate between label sheet holes and sheet holes passing only through the sheet. Therefore, if there are no label sheets made with label sheet holes, the controller 10 can determine if there are sheet holes in the label gap by detecting the scanning positions P2H and P3H even if one or both of scanning positions P1A and P4A cannot be identified.

Figure 6:
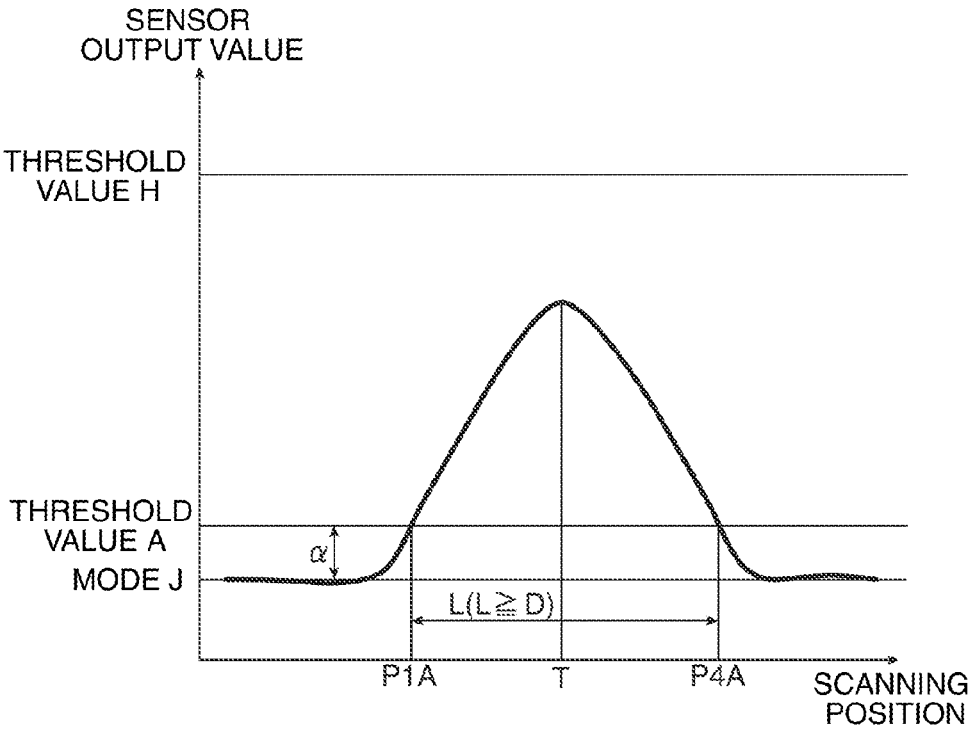
FIG. 6 describes the relationship between the scanning position and sensor output when using label sheets without holes in the perforations.

A method of identifying the seam position when sheet holes are not formed in the seams at the label gaps (as shown in FIG. 4 (B), for example) is described next. FIG. 6 describes the relationship between sensor output values and the scanning position of a label sheet in which holes are not rendered at the seams. This figure shows the sensor output values in the label gap and before and after the label gap.

As shown in the figure, the sensor output values begin rising when the scanning position approaches the sheet between labels. Sensor output peaks near the center of the sheet between labels, and then drops towards the trailing end of the sheet in the label gap.

If the controller 10 can identify scanning positions P1A and P4A and cannot identify scanning positions P2H and P3H, it determines that a sheet hole is not in the label gap. The controller 10 can detect the label gap, and then determines if the label gap is a slit that is narrower than the label gap. This is because the scanning positions P1A and P4A could be detected in the slit.

The controller 10 determines if the distance (interval) L between scanning positions P1A and P4A is greater than or equal to specific distance D. This specific distance D is a value for differentiating the label gap from a slit. The value can be determined by, for example, experimentally measuring the distance between scanning positions P1A and P4A that are detected when scanning the label gaps in label sheets of different specifications, and using the lowest detected value.

The controller 10 determines that the label gap is not a slit if the distance L between scanning positions P1A and P4A is greater than or equal to specific distance D. The controller 10 then identifies center position T at half the distance L between scanning positions P1A and P4A as the center of the label gap, that is, as the seam between label sheets.

After determining the seam position as described above, the controller 10 determines the length of a label sheet containing one label to be the distance from the leading end of the label sheet to the seam position. Based on this label sheet length, the controller 10 then drives the cutter 34 to cut the label sheet after every label.

The method of finding seams in the label sheet described above is described next with reference to the flow charts in FIG. 7 to FIG. 9.

Figure 7:
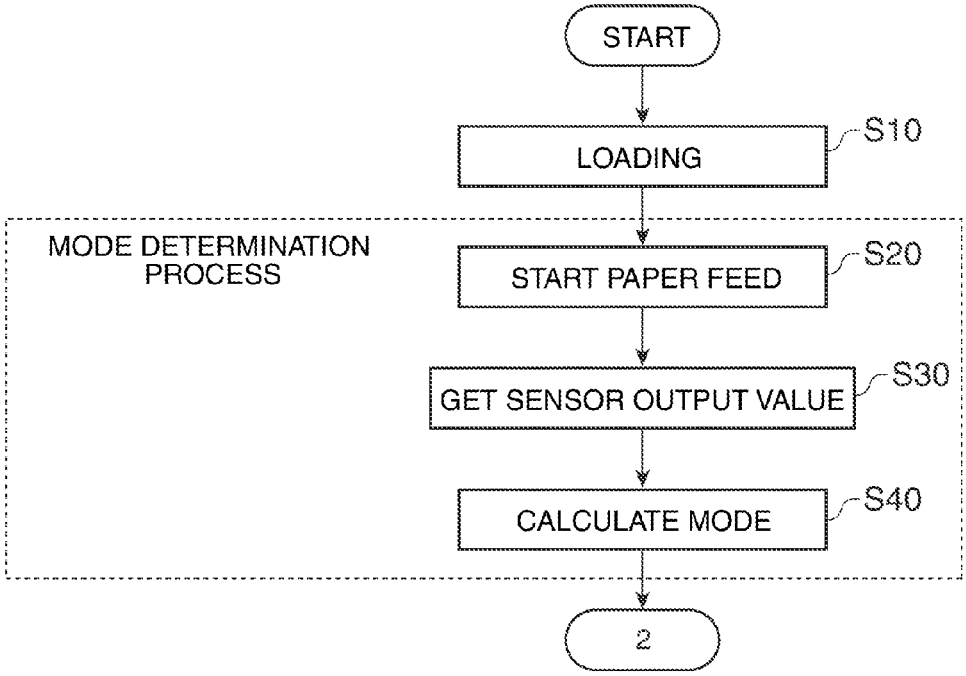
FIG. 7 shows an example of a process (first part) that detects seams in the label sheets.

FIG. 7 shows an example of the first part of the process that determines the seams in the label sheet. FIG. 8 shows an example of the second part of the process that identifies seams in the label sheet. FIG. 9 shows an example of the third part of the process that identifies seams in the label sheet.

Note that printing by means of the printhead 32 and cutting by means of the cutter 34 are not performed in the seam identification process.

The controller 10 loads the label sheet in S10. More specifically, the controller 10 drives the paper feed motor 31 to convey the leading end (the leading end when the label sheet has been correctly cut at a seam) of the label sheet inserted by the user to a specific starting position, and then pauses. The controller 10 then advances the process to S20.

The controller 10 starts the paper feed operation in S20. More specifically, the controller 10 drives the paper feed motor 31 and starts label sheet conveyance. The controller 10 then advances the process to S30.

The controller 10 captures the sensor output values in S30. More specifically, the controller 10 gets the sensor output values from the label detection unit 40 in the specific distance for calculating the mode J, and generates a histogram of the sensor output values. The controller 10 then advances the process to S40 after conveying the label sheet the specific distance.

In S40 the controller 10 calculates the mode. More specifically, the controller 10 detects the mode J of the sensor output values from the histogram generated in S30. The controller 10 then advances the process to S50 (FIG. 8).

In S50 the controller 10 sets the threshold value A for label gap detection and the threshold value H for detecting sheet holes in the label gap. More specifically, the controller 10 adds the specific value $\alpha$ to the mode J calculated in S40, and sets the sum as the threshold value A for label gap detection. A predetermined value is set as the threshold value H for sheet hole detection. The controller 10 then advances the process to S60.

The controller 10 captures the sensor output values in S60. More specifically, the controller 10 gets the sensor output values from the label detection unit 40. The controller 10 then advances the process to S70. Note that the values are captured at each specific paper feed distance in S60.

In S70 the controller 10 determines if a label gap was detected. More specifically, the controller 10 determines if scanning position P1A where the sensor output value becomes equal to threshold value A while rising, scanning position P2H where the sensor output value becomes equal to threshold value H while rising, scanning position P3H where the sensor output value becomes equal to threshold value H while decreasing, and scanning position P4A where the sensor output value becomes equal to threshold value A while decreasing, are detected in sequence. If all four scanning positions are found, or if only P1A and P4A are found, the controller 10 determines that a label gap was detected (S70 returns Yes) and then advances the process to S80. Otherwise, the controller 10 determines that a label gap was not detected (S70 returns No), and returns the process to S60. Note that even if all four scanning positions cannot be found, the controller 10 could determine that a label gap was detected if P2H and P3H are found.

In S80 the controller 10 determines if a sheet hole was detected. More specifically, the controller 10 determines if P2H and P3H were found in S70. If P2H and P3H were found, the controller 10 determines a sheet hole was detected (S80 returns Yes), and advances the process to S100. If P2H and P3H were not found, the controller 10 determines a sheet hole was not found (S80 returns No), and advances the process to S90.

In S90 the controller 10 determines if the length of the label gap is greater than or equal to the specific distance D. More specifically, the controller 10 determines if the distance L between P1A and P4A identified in S70 is greater than or equal to specific distance D. Note that distance L can be determined based on the number of sensor output values from P1A to P4A. If distance L is greater than or equal to specific distance D, the controller 10 determines the label gap is not a slit (S90 returns Yes), and advances the process to S100. If distance L is shorter than the specific distance, the controller 10 determines the label gap is a slit (S90 returns No), and returns the process to S60. Note that in this case the controller 10 resets at least scanning positions P1A and P4A identified in S70, and starts acquiring the sensor output values again in S60.

In S100 the controller 10 stops paper feed. More specifically, the controller 10 stops driving the paper feed motor 31. The controller 10 then advances the process to S110 (FIG. 9).

In S110, the controller 10 determines if a sheet hole was detected. More specifically, the controller 10 advances the process to S120 if S80 returned Yes (S110 returns Yes)). If S80 returned No (S110 returns No), the controller 10 advances the process to S130.

In S120 the controller 10 determines the center of the sheet hole. More specifically, the controller 10 sets the center position T at half the distance L between scanning positions P2H and P3H detected in S70 as the position of the seam between label sheets. The controller 10 then ends the process.

In S130, the controller 10 determines the center of the label gap. More specifically, the controller 10 sets the center position T at half the distance L between scanning positions P1A and P4A detected in S70 as the position of the seam between label sheets. The controller 10 then ends the process.

The position of a seam between label sheets can thus be accurately determined. Note that the controller detects the length from the leading end of the label sheet (the leading end of a label sheet that has been correctly cut at a seam) to the position of the detected seam (the trailing end of the label sheet) as the length of a label sheet containing one label. Label sheets each containing a single label can then be cut by means of the cutter 34 based on this label sheet length.

The process units in the flow charts described above are divided according to the main content of the steps in order to facilitate understanding the process executed by the label printer 1. The invention is not limited by how the steps are divided or the names used. The process executed by the label printer 1 can also be divided into a greater number of steps according to the process content. A single process unit could also be divided to include even more steps.

A preferred embodiment of the invention is described above. This embodiment of the invention can more accurately automatically identify the seams between individual label sheets in a label printer.

For example, this embodiment of the invention uses a threshold value A that is based on the mode and is sufficiently lower than the high sensor output values in the label gap. As a result, seams can be accurately identified because the locations of positions P1A and P4A are not affected even if the high sensor output values fluctuate in the label gap.

This embodiment of the invention also compares the distance L between scanning positions P1A and P4A with a specific distance D, for example. As a result, erroneously detecting a slit as a label gap can be minimized, and seams can be accurately identified.

Variation 1

Because threshold value A in the foregoing embodiment is the sum of mode J plus a specific value $\alpha$, detecting the label gap may not be possible if the difference between the mode and the maximum sensor output value for the label sheet is small. A first variation of the foregoing embodiment that addresses this problem is described next focusing on the differences with the above embodiment.

Figure 10:
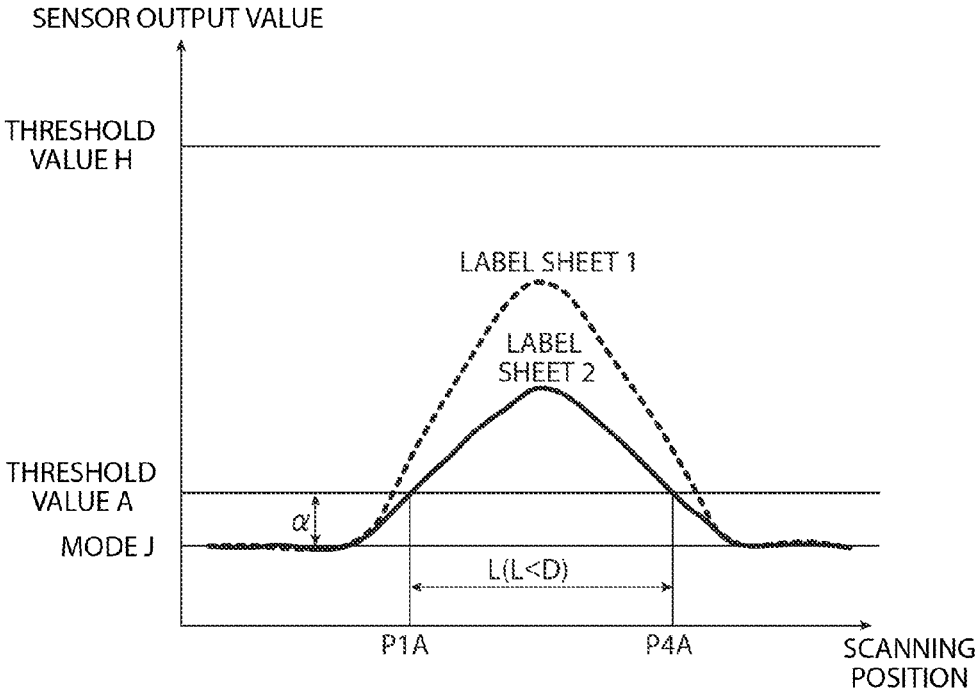
FIG. 10 describes the relationship between the scanning position and sensor output using label sheets with different transmittance.

FIG. 10 describes the relationship between scanning positions and sensor output values using label sheets with different transmittance. This figure shows the sensor output values detected from label sheets 1 and 2 with different transmittance in the label gap and before and after the label gap.

The transmittance of label sheet 2 is lower than the transmittance of label sheet 1 due, for example, to differences in the material or thickness of the label or sheet. As a result, the difference between the mode of the sensor output values and the maximum sensor output value is smaller with label sheet 2 than label sheet 1.

Therefore, if the specific value $\alpha$ is also used to calculate threshold value A for label sheet 2, the distance L between P1A and P4A will be shorter than the same distance L in label sheet 1. This distance L tends to become shorter as the difference between the mode and the maximum decreases.

As a result, distance L may become shorter than the constant distance D, and when this happens a label gap may be identified as a slit and the seam position T will not be found.

Figure 11:
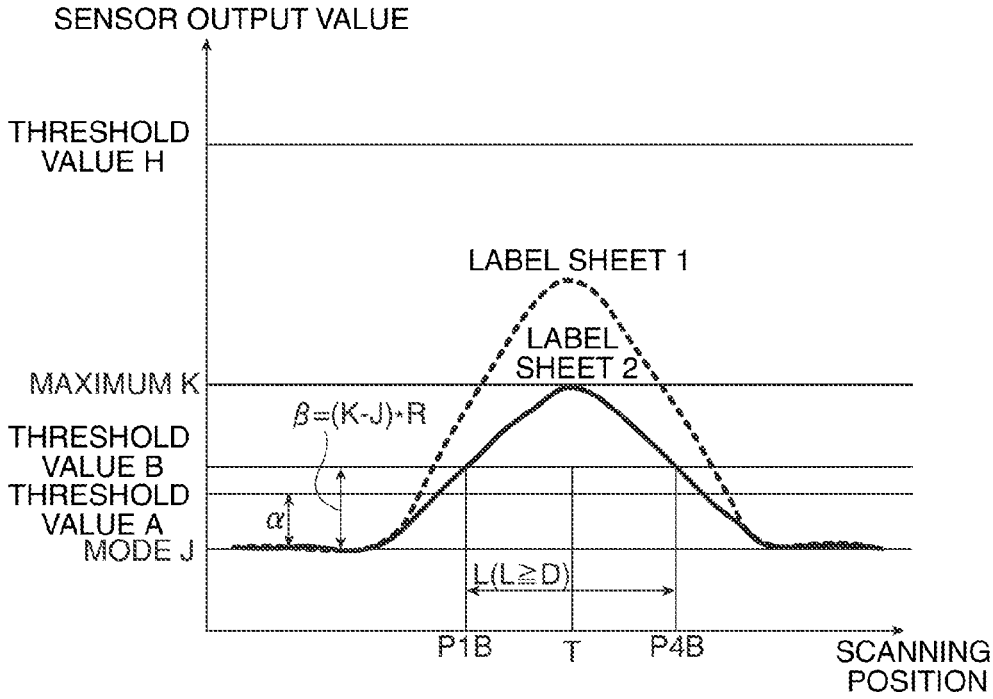
FIG. 11 describes the relationship between the scanning position and sensor output using label sheets with different transmittance.

This first variation therefore uses a threshold value B that corresponds to the transmittance characteristic of the label sheet in addition to threshold value A as shown in FIG. 11.

More specifically, the controller 10 continues conveying the label sheet after setting threshold value A and threshold value H. The controller 10 then tries to find position P1A where the sensor output value becomes equal to threshold value A while rising, position P2H where the sensor output value becomes equal to threshold value H while rising, position P3H where the sensor output value becomes equal to threshold value H while decreasing, and position P4A where the sensor output value becomes equal to threshold value A while decreasing.

If only P1A and P4A are found, the maximum sensor output value K between these positions is determined. The value β is also calculated using the equation ((maximum K−mode J)×specific ratio R), and this β is added to mode J to get threshold value B. A threshold value B corresponding to the characteristics of the label sheet is thus calculated.

Once threshold value B is set, the controller 10 finds position P1B where the sensor output value becomes equal to threshold value B while rising, and position P4B where the sensor output value becomes equal to threshold value B while falling. To differentiate the label gap from a slit, the controller 10 then determines if the distance L between scanning positions P1B and P4B is greater than or equal to specific distance D.

The specific ratio R is a value that is greater than or equal to the specific distance D that is used with different label sheets regardless of the distance L of the label sheets with different transmittance characteristics. Specific distance D and the distance L on label sheets with different transmittance characteristics both enable detecting the label gap.

Figure 12:
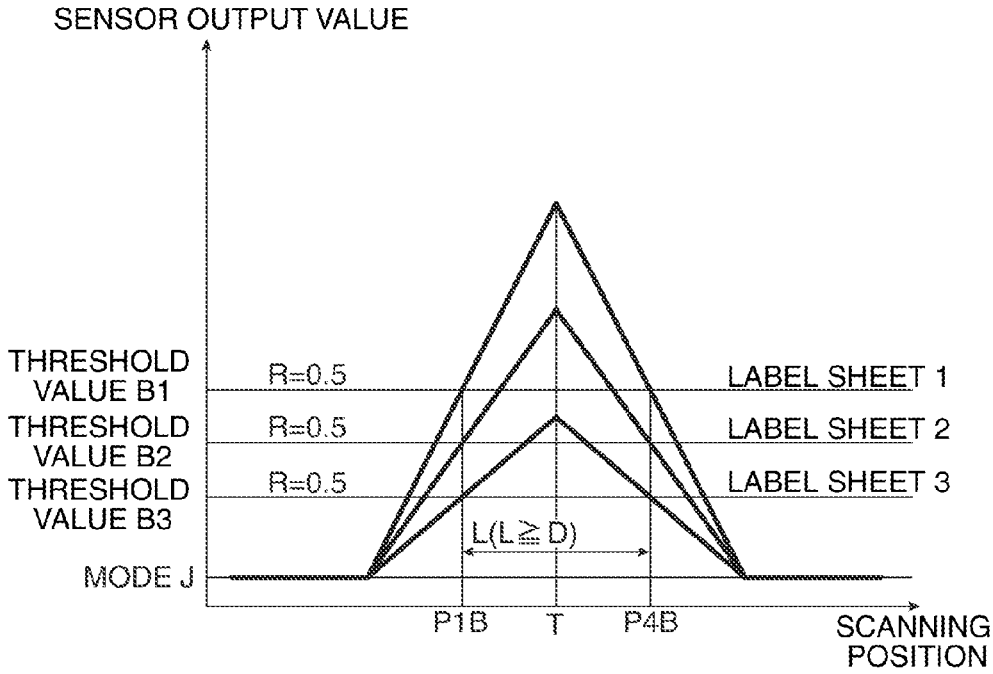
FIG. 12 describes a method of setting a threshold value suitable to label sheets with different transmittance.

For example, as shown in FIG. 12, the distance between labels on label sheets 1 to 3 with different transmittance is the same, and the change in sensor output can be approximated by lines that peak at the maximum sensor output value. If specific ratio R=0.5 in this case, distance L will be the same for all label sheets using the equation ((maximum K−mode J)×specific ratio R). Label gaps and slits can therefore be differentiated even in label sheets with different transmittance if distance D is less than or equal to distance L and is greater than distance L when there are slits. Note that these values are preferably measured experimentally and set to statistically determined optimum values.

The specific ratio R is also preferably set to a value that is not easily affected by variation that occurs based on the mode (low side) of the sensor output values for the label sheet, and variation in the sensor output value (high side) in the label gap. As a result, 0.5, which is the middle between the mode and the maximum, is an initial reference value. The invention is obviously not limited thereto, and experiments may be performed to get a statistically determined optimum value.

The controller 10 detects a label gap when the distance L between scanning positions P1B and P4B is greater than or equal to specific distance D. The controller 10 also determines the center position T, which is half the distance L between scanning positions P1B and P4B, is the center of the label gap, that is, is the position of the seam between label sheets.

This method of determining the seams between label sheets is described next with reference to the flow chart in FIG. 13. Note that the first part of the process that detects a seam between label sheets is the same as shown in FIG. 7. In addition, the third part of the process that detects a seam between label sheets is the same as shown in FIG. 9.

Figure 13:
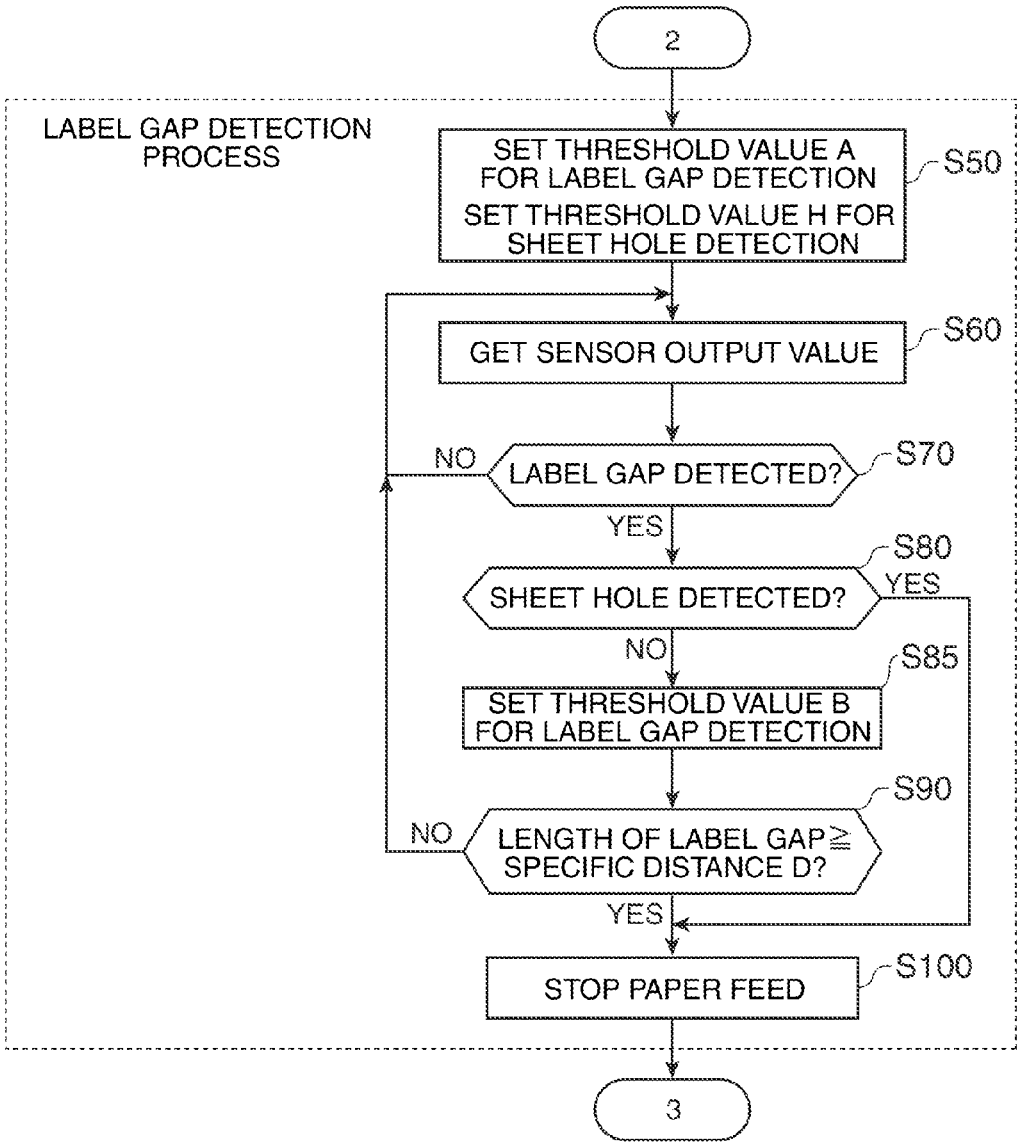
FIG. 13 describes a process (second part) that identifies seams in label sheets according to another embodiment of the invention.

FIG. 13 shows a variation of the second part of the process that detects a seam between label sheets.

Figure 8:
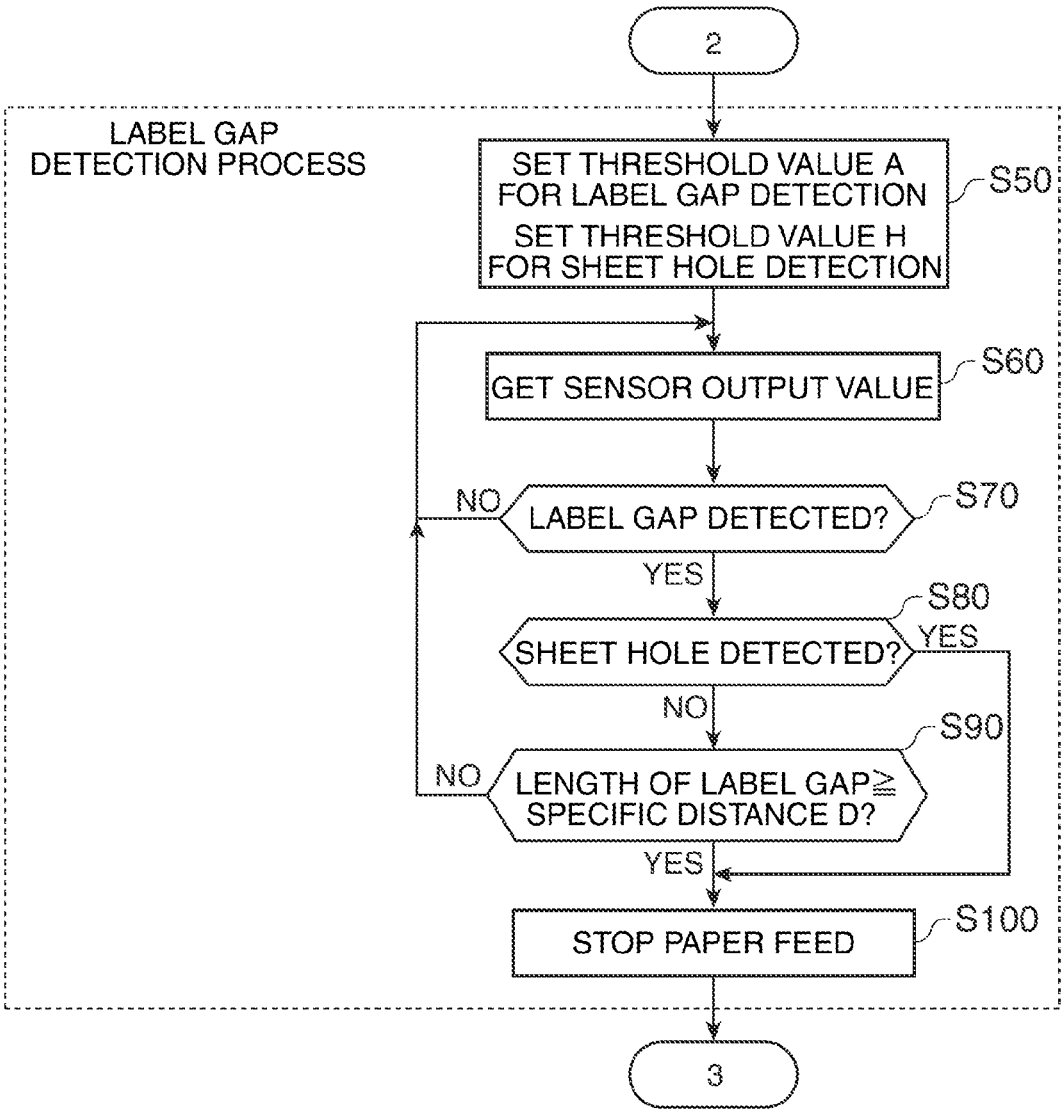
FIG. 8 shows an example of a process (second part) that detects seams in the label sheets.
Figure 9:
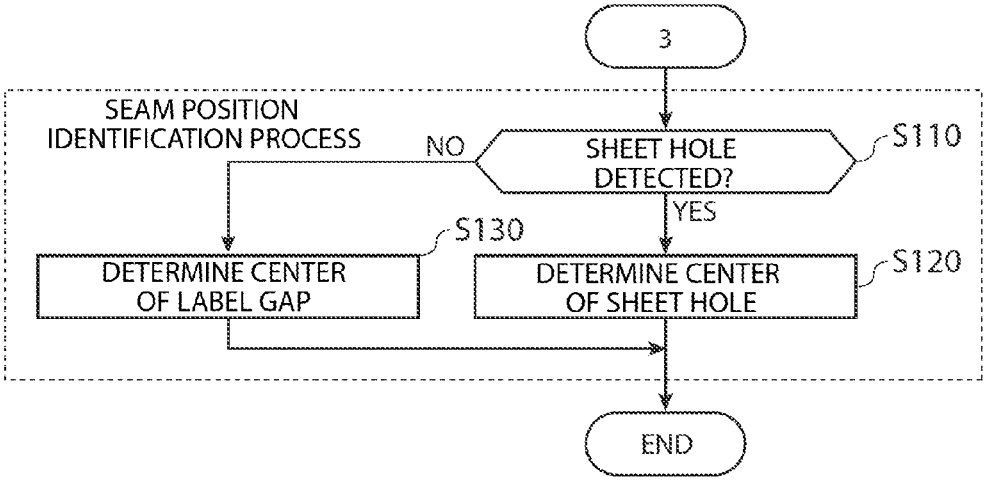
FIG. 9 shows an example of a process (third part) that detects seams in the label sheets.

S50 to S80, S90, and S100 are basically the same as in FIG. 8, and further description thereof is omitted. Note that in S80 the controller 10 advances the process to S85 when a sheet hole is not detected (S80 returns No).

In S85 the controller 10 sets the threshold value B for label gap detection. More specifically, the controller 10 determines the maximum K sensor output value between positions P1A and P4A. The controller 10 then calculates β by multiplying specific ratio R times the difference between maximum K and the mode J calculated in S40, adds β to mode J, and sets the sum as the threshold value B for label gap detection. The controller 10 then advances the process to S90.

In S90 the controller 10 determines if the length of the label gap is greater than or equal to specific distance D. More specifically, the controller 10 determines scanning positions P1B and P4B based on the sensor output values between P1A and P4A, and the threshold value B set in S85. The controller 10 then calculates the distance L between scanning positions P1B and P4B as the length of the label gap, and determines if this distance L is greater than or equal to specific distance D. If distance L is greater than or equal to specific distance D, the controller 10 determines the label gap is not a slit (S90 returns Yes), and advances the process to S100. If distance L is shorter than the specific distance, the controller 10 determines the label gap is a slit (S90 returns No), and returns the process to S60. Note that in this case the controller 10 resets at least the identified scanning positions P1A and P4A, and P1B and P4B, and begins capturing sensor output values again in S60.

Note that in S130 the controller 10 identifies the center position T at half the distance L between scanning positions P1B and P4B identified in S90 as the position of the seam between label sheets.

As thus described, this embodiment of the invention can more accurately automatically identify seams between each sheet of label sheet media even when using label sheets with different transmittance characteristics. For example, a threshold value B that is determined according to the transmittance characteristic of the label sheet is used in this embodiment. As a result, seams can be accurately identified even when label sheets with different transmittance are used.

In addition, threshold value B is set to a high value that is not easily affected by variation in the sensor output values on the low transmittance side and variation in the sensor output values on the high transmittance side. As a result, seams can be accurately identified even in label sheets with variations in transmittance.

Variation 2

The label sheets could also have an area that is used for RFID applications. A semiconductor device that stores identification information, and an antenna that exchanges the identification information with an external device, for example, is disposed in this area. Using this area to determine the mode of the sensor output values is therefore not appropriate. The label printer 1 according to this second variation therefore operates without using the sensor output values in the RFID area. This variation is described with particular reference to the differences with the embodiment described above.

Figure 14:
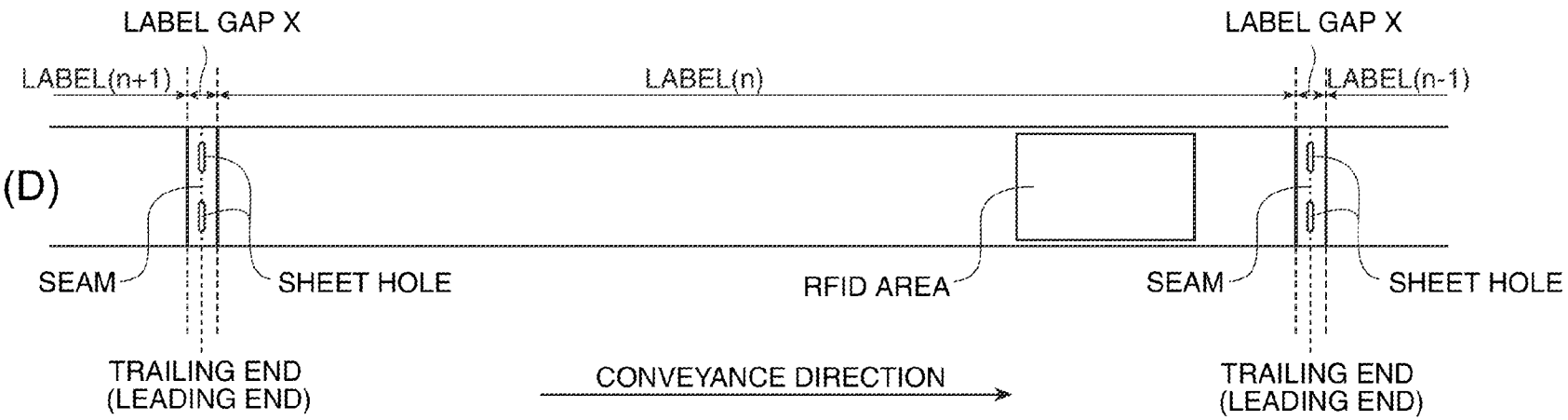
FIG. 14 shows an example of label sheets with an RFID area.

FIG. 14 shows an example of a label sheet with an RFID area.

As shown in the figure, the label sheet (D) has an RFID area on the leading end side (in the conveyance direction) of the middle of the label. While not shown in the figures, a semiconductor chip or antenna is disposed in the RFID area. The size of the RFID area and its position on the label is predetermined according to a standard. The specifications of this label sheet are obviously for example only, and the shape, location, size, and other aspects of the RFID area are not limited to the foregoing.

The controller 10 does not capture the sensor output values for a specific distance including the RFID area after starting paper feed, and uses the sensor output values acquired from locations outside this specific distance.

This method of identifying seams between label sheets is described next with reference to the flow chart in FIG. 15. Note that the second part of the process that detects a seam between label sheets is the same as shown in FIG. 8. In addition, the third part of the process that detects a seam between label sheets is the same as shown in FIG. 9.

Figure 15:
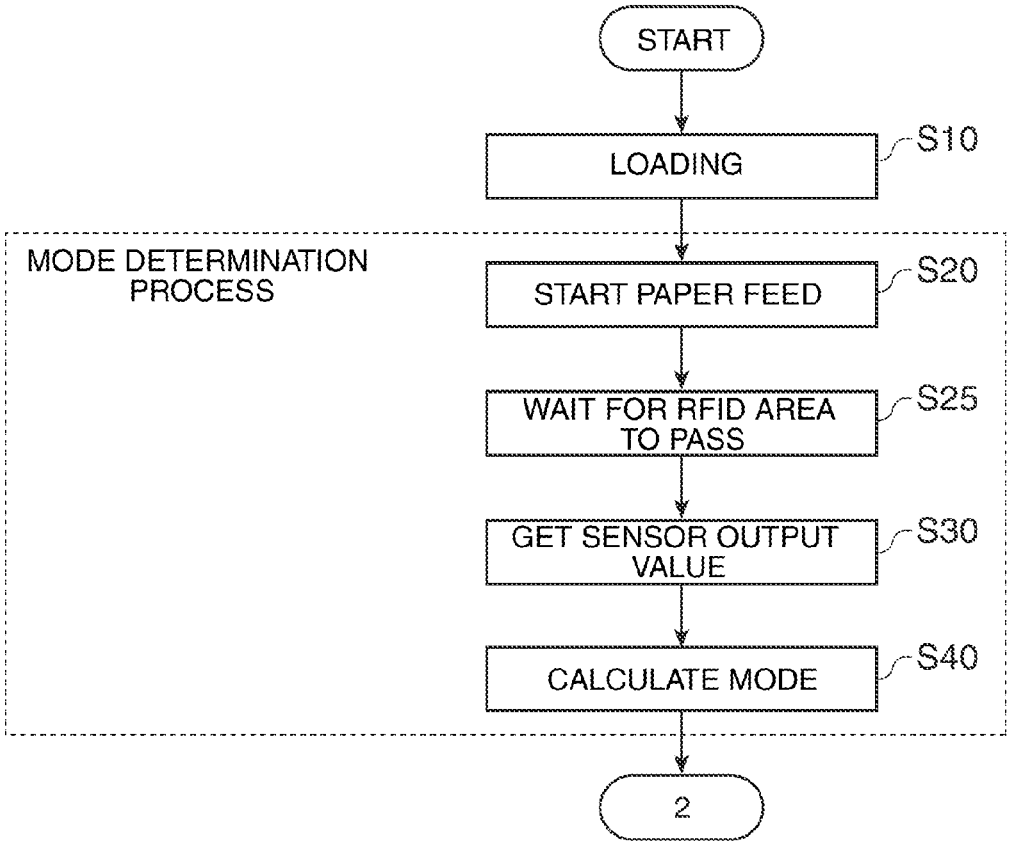
FIG. 15 describes a process (first part) that identifies seams in label sheets according to another embodiment of the invention.

FIG. 15 shows a variation of the first part of the process that detects a seam between label sheets.

S10, S20, S30, and S40 are basically the same as in FIG. 7, and further description thereof is thus omitted. Note also that the controller 10 starts paper feed in S20, and then advances the process to S25.

In S25 the controller 10 waits for the RFID area to pass. More specifically, the controller 10 discards the sensor output values from the label detection unit 40 during the specific distance including the RFID area. After this specific length of media passes, the controller 10 advances the process to S30. Note also that the controller 10 could stop reading output from the label detection unit 40 for this specific distance.

The location of a seam can thus be accurately identified even when using label sheets that have an RFID area. A combination including variation 2 and variation 1 above is also conceivable.

Variation 3

Label sheets that have a special slit of approximately the same width as the label gap are also conceivable. In this case the slit could be mistakenly recognized as a label gap even when evaluated using specific distance D. A label printer 1 according to this third variation therefore continues the evaluation even after a label gap is detected while conveying the label sheet. This variation is described focusing on the differences with the foregoing embodiment.

Figure 16:
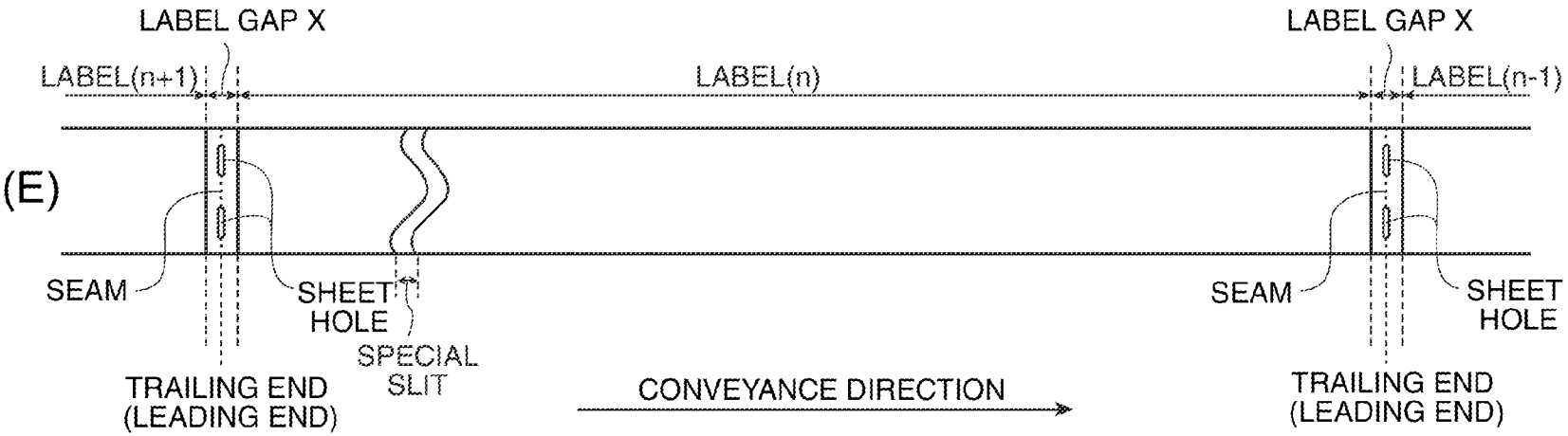
FIG. 16 shows an example of a label sheet with a special slit.

FIG. 16 shows an example of a label sheet with a special slit.

As shown in the figure, label sheet (E) has a special slit on the trailing end side (in the conveyance direction) of the middle of the label. This special slit is a curved area instead of a rectangular area as in the label gap. Its width is also close to the width of the label gap. A sheet hole is also rendered in the label gap of label sheets that have a special slit according to standard. The position of a special slit according to standard is also set within a specific distance from the label gap. The specifications of this label sheet are, of course, for example only, and the shape, location, size, and other aspects of the special slit are not limited thereto.

The controller 10 continues paper conveyance even after a label gap is detected, and determines if a sheet hole was detected. If a sheet hole was detected, the center of the sheet hole is identified as the location of the seam. If conveying the label sheet the specified distance ends without detecting a sheet hole after a label gap is detected, the center of the first detected label gap is identified as the location of the seam. Note that this specific distance may be the maximum distance from a special slit to a position including a label gap that is possible among label sheets of different specifications each including a special slit.

This method of identifying seams between label sheets is described next with reference to the flow chart in FIG. 17. Note that the first part of the process that detects a seam between label sheets is the same as shown in FIG. 7. In addition, the third part of the process that detects a seam between label sheets is the same as shown in FIG. 9.

Figure 17:
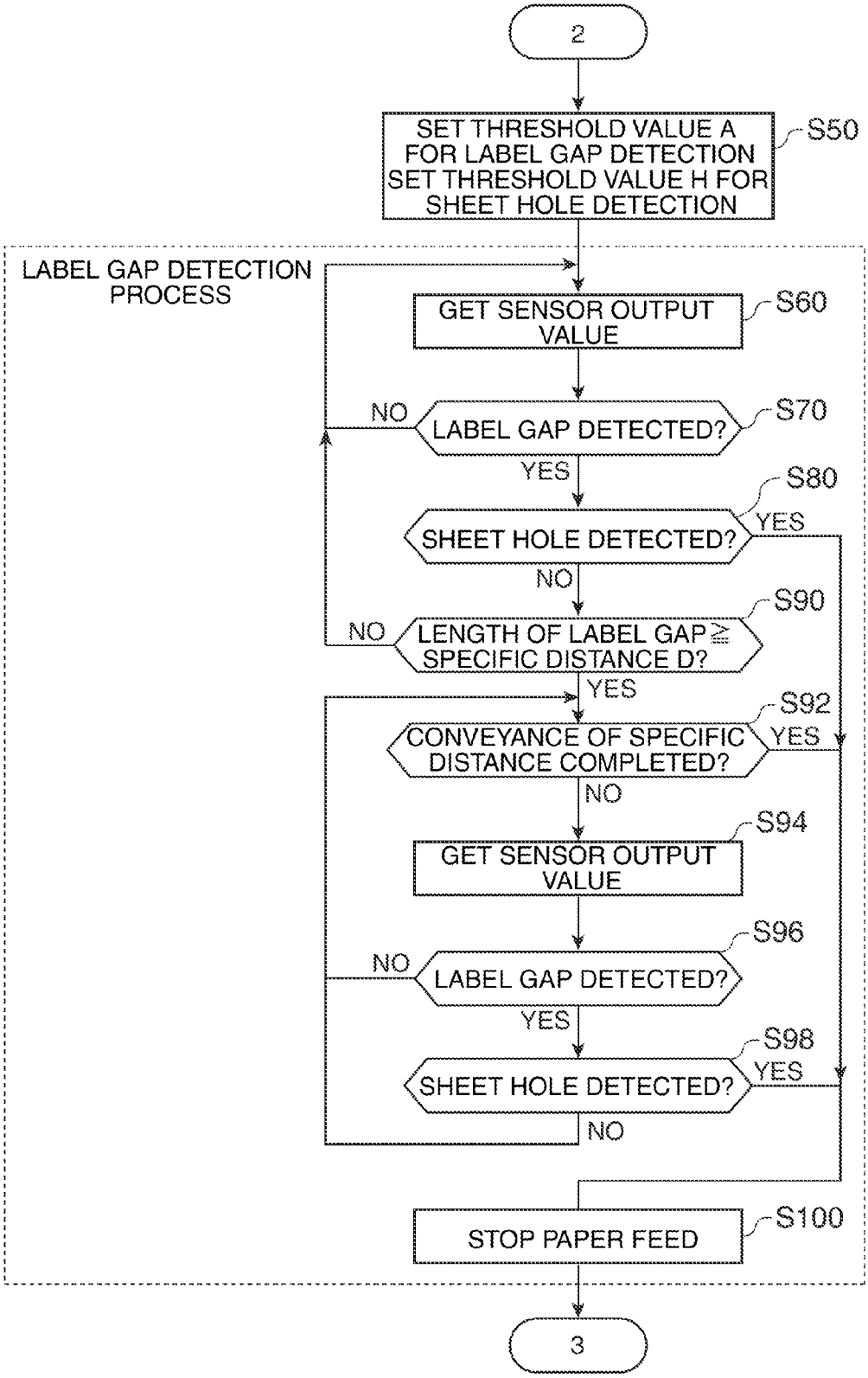
FIG. 17 describes a process (second part) that identifies seams in label sheets according to another embodiment of the invention.

FIG. 17 shows a variation of the second part of the process that detects a seam between label sheets.

S50 to S90 and S100 are basically the same as in FIG. 8, and further description thereof is omitted. Note that when in S90 the distance L is greater than or equal to specific distance D (S90 returns Yes), the controller 10 advances the process to S92.

In S92 the controller 10 determines if conveying the media the specified distance is completed. More specifically, the controller 10 determines if the conveyance distance since S90 returned Yes is greater than the specific distance from a special slit to a position including a label gap. If conveyance this specific distance has not ended (S92 returns No), the controller 10 advances the process to S94. If conveyance this specific distance has ended (S92 returns Yes), the controller 10 advances the process to S100.

In S94 the controller 10 acquires the sensor output value. More specifically, the controller 10 acquires the sensor output values from the label detection unit 40 and then advances the process to S96. Note that the values for each specified conveyance distance are acquired in S96.

In S96 the controller 10 determines if a label gap was detected. More specifically, the controller 10 determines if scanning position P1A where the sensor output value becomes equal to threshold value A while rising, scanning position P2H where the sensor output value becomes equal to threshold value H while rising, scanning position P3H where the sensor output value becomes equal to threshold value H while decreasing, and scanning position P4A where the sensor output value becomes equal to threshold value A while decreasing are detected in sequence. If all four scanning positions are found, or if only P1A and P4A are found, the controller 10 determines that a label gap was detected (S96 returns Yes) and then advances the process to S98. Otherwise, the controller 10 determines that a label gap was not detected (S96 returns No), and returns the process to S92.

In S98 the controller 10 determines if a sheet hole was detected. More specifically, the controller 10 determines if P2H and P3H were found in S96. If P2H and P3H were found, the controller 10 determines a sheet hole was detected (S98 returns Yes), and advances the process to S100. If P2H and P3H were not found, the controller 10 determines a sheet hole was not found (S98 returns No), and returns the process to S92.

In S110 the controller 10 advances the process to S120 if Yes was returned in S80 or S98 (S110 returns Yes). If S92 returned Yes (S110 returns No), the controller 10 advances the process to S130. In S120 the controller 10 sets the center position T at half the distance L between P2H and P3H detected in S70 or S96 as the position of a seam between label sheets. In S130, the controller 10 sets the center position T at half the distance L between P1A and P4A detected in S70 as the position of a seam between label sheets.

Seams between individual label sheets can thus be more accurately automatically detected even in label sheets having a special slit. It will also be obvious that this variation 3 can also be used in combination with variation 1 or variation 2.

Variation 4

In the embodiment and variations thereof described above, the controller 10 uses the output from one previously selected photodetection element when the photodetector 40*a* includes a plurality of photodetection elements, but the photodetection element that is used can be selected conditionally.

The controller 10 could, for example, execute steps S30 to S70 (FIG. 7 to FIG. 9) for each of plural photodetection elements, and choose the photodetection element that outputs a sensor output value corresponding to scanning position P1 first (that is, at the earliest time) as the photodetection element used for the following steps. The controller could also discard the output values from the photodetection elements that were not chosen, or stop operation of those photodetection elements. Output from the light-emitting elements corresponding to the photodetection elements that were not selected could also be stopped.

The controller 10 could also execute steps S30 to S70 (FIG. 7 to FIG. 9) for each of plural photodetection elements, and choose the photodetection element that outputs sensor output values corresponding to all four scanning positions, P1A and P4A, or P2H and P3H, first as the photodetection element used for the following steps. The photodetection element for which S80 first returns Yes, or the photodetection element for which S90 first returns Yes, could also be selected as the photodetection element used in the following steps. The controller could also discard the output values from the photodetection elements that were not chosen, or stop operation of those photodetection elements. Output from the light-emitting elements corresponding to the photodetection elements that were not selected could also be stopped.

Variation 5

The shape of the label gap may also be determined using sensor output values from a plurality of photodetection elements.

In this case, for example, the controller 10 determines scanning positions P1 and P4 based on each photodetection element. The shape of the label gap is then determined based on the relationship between the locations of scanning positions P1 and P4 at each device and the length of distance L. The controller 10 determines whether or not the shape of the label gap is a rectangle perpendicular to the conveyance direction, for example. If it is not rectangular, the controller 10 determines the gap to be a slit.

Further alternatively, the controller 10 may determine scanning positions P2 and P3 based on each photodetection element, and based on the relationship between the location of scanning positions P2 and P3 at each element and the length of distance L, determine the position of the sheet hole, the shape of the sheet hole, or the number of sheet holes, for example.

The foregoing embodiment of the invention and variations thereof are intended to describe the scope and main aspects of the invention, and do not limit the invention. Many substitutions, modifications, and variations thereof will be apparent to one with ordinary skill in the related art. Configurations combining one or more of the foregoing embodiment and variations thereof are also conceivable.

Note that the invention is not limited to transmissive sensors, and can be applied with reflective sensors or other type of sensor.

In addition, after calculating the length of a label sheet of one label, the label printer according to this embodiment of the invention cuts the label sheet each time the media is conveyed the calculated length until the roll is replaced. Alternatively, after the distance from a first sheet position or second sheet position to the sheet seam is stored, and the first sheet position or second sheet position is determined, the label sheet could be conveyed the distance to the seam and the label sheet then cut. Of course, the location of the sheet seam could be identified label by label to cut the label sheet.

KEY TO THE FIGURES

1 label printer
10 controller
20 operating panel
30 print unit
31 paper feed motor
32 printhead
33 platen roller
34 cutter
34*a* top knife
34*b* bottom knife
40 label detection unit
40*a* photodetector
40*b* light-emitting device

What is claimed is:

1. A label conveyance device that conveys a label sheet having a plurality of labels arrayed with a gap therebetween on a sheet, comprising:

a sensor that scans the label sheet and outputs a sensor output value; and a controller that:

determines a mode of sensor output values;

determines a first sheet position in the label sheet conveyance direction where the sensor output value exceeds a first threshold value that is set according to the mode and used for detecting a part of the sheet between labels, a second sheet position where the sensor output value exceeds a second threshold value that is greater than the first threshold value and is used for detecting a hole in the label sheet, a third sheet position where the sensor output value is less than the second threshold value, and a fourth sheet position where the sensor output value is less than the first threshold value; and determines that the center of a first interval from the first sheet position to the fourth sheet position is the position of a seam in the sheet between labels when the first sheet position and the fourth sheet position are identified and the second sheet position and the third sheet position are not identified, and determines that the center of a second interval from the second sheet position to the third sheet position is the position of a seam in the sheet between labels when the second sheet position and the third sheet position are identified.

2. The label conveyance device described in claim 1, wherein:

the first threshold value is the sum of the mode plus a specific value.

3. The label conveyance device described in claim 1, wherein the controller further determines the maximum sensor output value;

and wherein the first threshold value is set according to the difference between the mode and the maximum.

4. The label conveyance device described in claim 3, wherein the controller further sets the sum of a specific ratio of the difference between the mode and the maximum plus the mode as the first threshold value.

5. The label conveyance device described in claim 1, wherein the controller further determines if the length of the first interval exceeds a specific distance if the first sheet position and the fourth sheet position are determined and the second sheet position and third sheet position are not determined, and determines that the center of the first interval is the position of a seam in the sheet between labels if the length of the first interval exceeds the specific distance.

6. The label conveyance device described in claim 1, wherein the controller further determines if the length of the first interval exceeds a specific distance if the first sheet position and the fourth sheet position are determined and the second sheet position and third sheet position are not determined, and resets at least the first sheet position and the fourth sheet position without determining the position of a seam in the sheet between labels if the length of the first interval does not exceed the specific distance.

7. The label conveyance device described in claim 1, wherein the controller further:

determines the mode using a sensor output value in a first specific interval after starting conveyance of the label sheet; and determines each sheet position using a sensor output value in an interval downstream in the conveyance direction from the specific interval.

8. The label conveyance device described in claim 1, wherein the controller continuously determines and updates the mode using the sensor output value after starting conveyance of the label sheet.

9. The label conveyance device described in claim 1, wherein:

a second specific interval in which a chip storing identification information and an antenna for communicating the identification information is disposed to the label; and the controller does not use a sensor output value in the second specific interval to determine the mode.

10. The label conveyance device described in claim 1, wherein the controller further:

uses a sensor output value in an interval conveyed after the center of the first interval is identified as the position of a sheet seam between labels to determine the second sheet position and the third sheet position; and determines the center of the first interval is the position of a sheet seam between labels when the second sheet position and the third sheet position are not determined, and determines the center of a second interval from the second sheet position to the third sheet position is the position of a sheet seam between labels when the second sheet position and the third sheet position are determined.

11. The label conveyance device described in claim 1, wherein:

the sensor is a light-emitting element and a photodetection device, or an ultrasonic emitting device and an ultrasonic detection device, disposed to opposing positions with the label sheet therebetween.

12. The label conveyance device described in claim 1, wherein:

the sensor comprises a plurality of sensors, wherein the plurality of sensors scan the label sheet at a plurality of positions arrayed perpendicularly to the conveyance direction of the label sheet, and can output a sensor output value at each of the plural positions.

13. The label conveyance device described in claim 12, wherein:

the controller can function using sensor output values from the plural positions, and of the sensors disposed to the plural positions, use the sensor that first outputs a sensor output value identifying the first sheet position as the sensor for determining subsequent sheet positions.

14. The label conveyance device described in claim 12, wherein:

the controller can function using sensor output values from the plural positions, and of the sensors disposed to the plural positions, use the sensor that first outputs a sensor output value identifying the seam position as the sensor for determining subsequent sheet positions.

15. The label conveyance device described in claim 12, wherein:

the controller can function using sensor output values from the plural positions, and the controller further determines the shape of the sheet part between labels based on the sheet positions identified by each sensor output value.

16. A sheet seam determination method of a label conveyance device that conveys a label sheet having a plurality of labels arrayed with a gap therebetween on a sheet, and has a sensor that scans the label sheet and outputs a sensor output value, the sheet seam determination method comprising:

determining a mode of sensor output values;

determining a first sheet position in the label sheet conveyance direction where the sensor output value exceeds a first threshold value that is set according to the mode and used for detecting a part of the sheet between labels;

determining a second sheet position in the label sheet conveyance direction where the sensor output value exceeds a second threshold value that is greater than the first threshold value and is used for detecting a hole in the label sheet;

determining a third sheet position in the label sheet conveyance direction where the sensor output value becomes less than the second threshold value;

determining a fourth sheet position in the label sheet conveyance direction that is less than the first threshold value;

determining the center of a first interval from the first sheet position to the fourth sheet position is the position of a seam in the sheet between labels if the second sheet position and the third sheet position are not identified when the fourth sheet position is identified; and determining the center of a second interval from the second sheet position to the third sheet position is the position of a seam in the sheet between labels if the second sheet position and the third sheet position are identified when the fourth sheet position is identified.

* * * * *